United States Patent [19]

Matsui

[11] 4,330,893

[45] May 25, 1982

[54] WATER BED

[76] Inventor: Ichinosuke Matsui, No. 14-11, Shimoochiai 2-chome, Shinjuku-ku, Tokyo, Japan

[21] Appl. No.: 87,444

[22] Filed: Oct. 22, 1979

[51] Int. Cl.[3] ..... A47C 27/08; A47G 9/00

[52] U.S. Cl. ..... 5/451; 5/457; 5/499; 5/474

[58] Field of Search ..... 5/451, 452, 449, 457, 5/458, 474, 499, 482

[56] References Cited

U.S. PATENT DOCUMENTS

| | | | |
|---|---|---|---|
| 1,306,787 | 6/1919 | Stevenson | 5/449 |
| 1,382,831 | 4/1921 | Hilker | 5/434 |
| 3,206,776 | 9/1965 | Moore | 5/457 |
| 3,722,012 | 3/1973 | Tobinick et al. | 5/451 |
| 3,736,604 | 6/1973 | Carson, Jr. | 5/455 |
| 3,848,282 | 11/1974 | Viesturs | 5/508 |
| 4,167,795 | 9/1979 | Lambert, Jr. | 5/458 |
| 4,193,151 | 3/1980 | Calleance | 5/455 |
| 4,245,364 | 1/1981 | Calleance | 5/451 |

*Primary Examiner*—Alexander Grosz

*Attorney, Agent, or Firm*—Lane, Aitken, Kice & Kananen

[57] ABSTRACT

A water bed employing a mattress in the form of a water-tight bag of flexible sheet material and having means for restricting swelling deformations in the peripheral portion of the top sheet of the bag.

2 Claims, 4 Drawing Figures

WATER BED

BACKGROUD OF THE INVENTION (1) Field of the Invention

This invention relates to an improvement in water bed.

(2) Description of Prior Art

In general, the water bed employs a mattress in the form of a water-tight bag of flexible material which is to be filled with water to support a sleeper's lying body with uniform force by utilization of the property of the uniformly acting water pressure. One can get a comfortable sleep on the water bed since the body is supported not in one particular part but by the force which acts uniformly on every part of the body.

A problem of a water bed which uses as a matress a bag which is simply filled with water is that, upon lying on the bed, one's body is more or less sunk into the bag depending upon the body weight, pushing water to outer portions of the bag. As a result, the peripheral portions of the bag swell out to oppress from opposite sides the body as well as the head of the sleeper giving the sleeper a feeling of oppression. In addition, the bag portions which swell out around the sunken body block movements of the sleeper's arms. The sleeper cannot stretch out his or her arms and has to keep them at opposite sides of his or her body in a restrained state.

SUMMARY OF THE INVENTION

The present invention contemplates to solve the above-mentioned problems of the conventional water beds and has its object the provision of a water bed which is provided with means for preventing the sleeper's body from sinking into the water bag without impairing the inherent function of the water bed, that is to say, the function of uniformly supporting the sleeper's body.

According to the present invention, there is provided a water bed comprising a mattress in the form of a water-tight bag, which bag having at least the top side thereof formed from a flexible sheet material and being provided with means for restricting swelling deformation of the peripheral portions of the bag when a sleeper's body weight is put in the middle portion thereof.

BRIEF DESCRIPTION OF THE DRAWINGS

The accompanying drawings show by way of example preferred embodiments of the present invention, in which.

DESCRIPTION OF PREFERRED EMBODIMENTS

Figure 1:
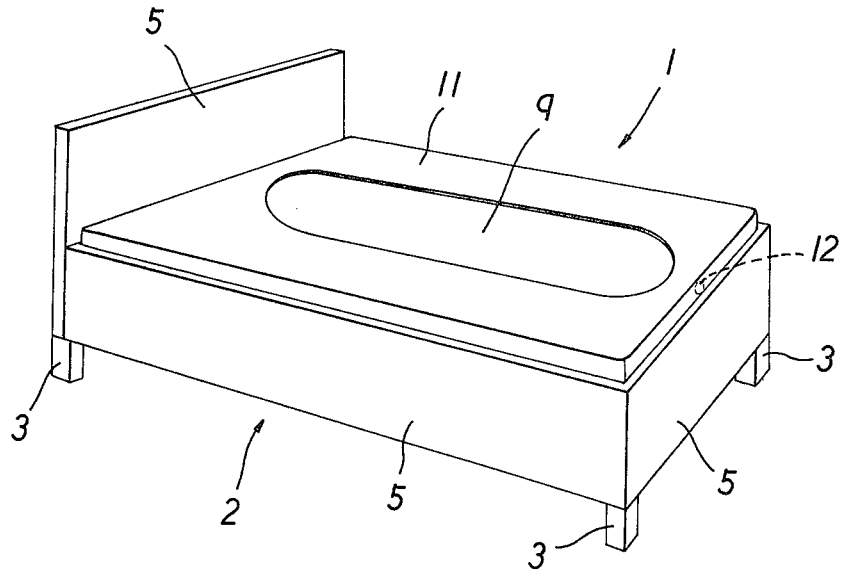
FIG. 1 is a perspective view of a water bed according to the invention.
Figure 2:
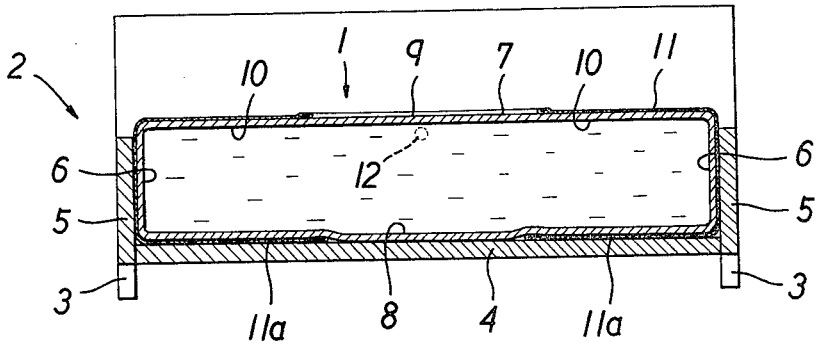
FIG. 2 is a sectional view of the bed of FIG. 1.

Referring to FIGS. 1 and 2, the water bed according to the present invention has a mattress in the form of a water-tight bag 1 fitted in an opening on a bedstead 2 including a bottom plate 4 and side plates 5 which enclose the four sides of the water bag 1. The water bag 1 is formed from a water-tight flexible material such as rubber, a soft synthetic resin, water-proof cloth or the like and, when filled with water, its four sides are supported by the side plates 5 of the bedstead 2. The top sheet 7 of the water bag 1 is preferred to be as flexible as possible in order to ensure that the body of a sleeper lying on the top sheet 7 is uniformly supported by the water pressure. However, the side and bottom sheets 6 and 8 of the bag 1, which are contactingly supported by the bedstead 2, are not necessarily required to be flexible.

Except for a center portion 9 which receives the sleeper's body, the flexible top sheet 7 of the bag 1 is covered with an anti-deformation cover 11 of cloth or a synthetic resin sheet of low elasticity with an opening in the center portion thereof. The anti-deformation cover 11 is tucked under the water bag 1 as indicated at 11*a* and thus tightly fitted on the bag 1. The tucked portions 11*a* of the cover 11 should be of the shape and size which are suitable for fixing the cover 11 in position.

When one lies on the center portion of the top sheet 7, water in the center portion of the bag 1 is pushed toward the peripheral portions 10. However, at this time the anti-deformation cover 11 restricts at least upheaval or upward movement of the peripheral portions 10 of the top sheet 7, limiting the displacement of water towards the peripheral portions 11, so that the center portion of the top sheet 7 is caved in only in a slight degree and the lying body is supported thereon without sinking oppresively deep into the bag 1. Although the upheaval of the top sheet 7 in its peripheral portion 10 is restricted by the anti-deformation cover 11, the peripheral portion 10 is depressible and gives the same uniform support to a part of the body as on the center portion 9.

The water bag 1 is provided with a port 12 of a known construction which serves for charging and discharging water and for purging residual air from the water bag 1. An air escape may be provided in the top sheet of the water bag 1 to purge air therethrough when filling water into the bag 1. Needless to say, the just-mentioned port 12 and air escape are normally closed by detachable plugs.

Figure 3:
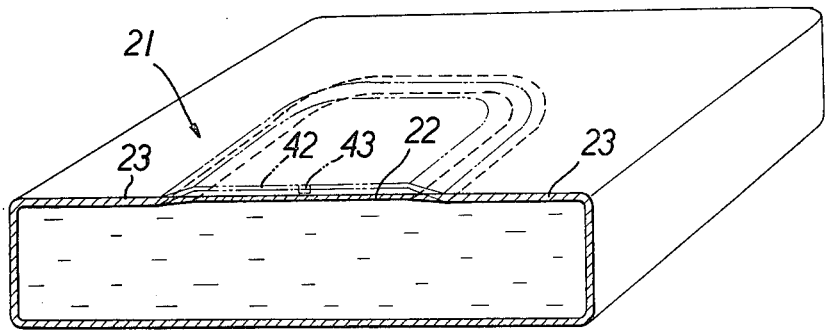
FIGS. 3 and 4 are views similar to FIG. 2 but showing different embodiments of the invention.

Referring to FIG. 3, there is shown a water bag 21 which has the peripheral portion 23 of its top sheet formed in a greater thickness than the center portion 22 thereby imparting higher shape-retaining property to the peripheral portion 23 for preventing excessive upheaval or swelling deformation thereof. It is preferred that the thickness of the top sheet is increased gradually outward at the boundary of the center portion 22. In this embodiment, the part of the body which lies on the peripheral portion 22 of increased thickness is not supported by a uniform force. However, this occurs to only a limited part of the body and does not give adverse effects to the comfort on the bed in any material degree.

Figure 4:
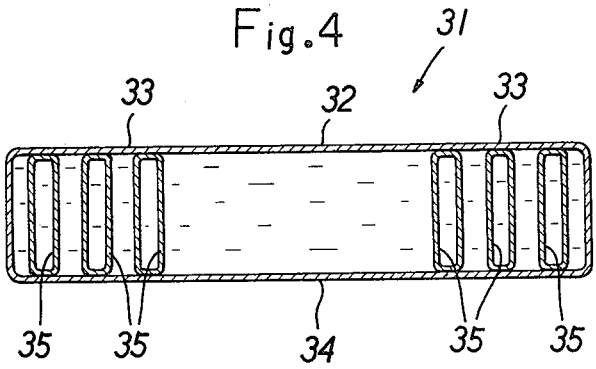

Shown in FIG. 4 is a water bag 31 which has the peripheral portion 33 of its top sheet, except the center portion 32, interconnected with its bottom sheet 34 by a number of connecting strips 35 of similar flexible material. In order to prevent the connecting strips 35 or the top sheet from being ruptured by the pressure of upsurging water tending to upheave the peripheral portion 33 of the top sheet, it is recommended to provide a large number of connecting strips in the area of the peripheral portions 33 of the top sheet or to provide connecting strips of flexible water-permeable material like sponge in a manner to disperse or attenuate the pressure of water surges.

In the foregoing embodiment, the center portion 22 of the top sheet may be formed in relief 42, raised from the peripheral portion 23 as indicated in phantom in FIG. 3, with a port 43 to be used for charging and discharging water and for purging residual air out of the bag 21. When filling water into the bed through the port in the bag, it is important to purge air completely from the water bag since existence of residual air will considerably impair the comfortableness on the bed and produce very offensive noises by movements within the bag. Where the top sheet has its center portion raised as indicated at 42, residual air is collected beneath the center portion 42 as water is filled into the bag and thus can be easily purged through the port 43 which is provided in the raised center portion 42. A body weight placed on the raised center portion tends to push an increased amount of water toward the peripheral portion of the top sheet, but the swelling deformation of the peripheral portion is suppressed by the afore-mentioned restricting means, delimiting outward displacement of water. Therefore, the body is supported on a relatively flat surface without sinking into the raised center portion of the top sheet. The raised center portion 42 which contains the port 43 is made of a flexible sheet so that there is no possibility of the lying body being hurt by the port 43.

In the foregoing embodiments, the water bag is shown as being mounted on a bedstead 2. However, if desired, the water bag 1 may be used on a floor, fitted in a box-like frame similar to the side and bottom plates of the bedstead 2 or in a simple rectangular frame without a bottom plate.

As clear from the foregoing description, the water bed according to the present invention retains the effects which are inherent only to the water bed, while preventing a sleeper's body from sinking into the bag to relieve the head and body of the sleeper of the oppression due to the swelling deformation of the top sheet of the bag.

What is claimed is:

1. A water bed comprising a mattress in the form of a water-tight bag having at least the top side thereof formed of a flexible sheet material, said top side being composed of a flexible center portion sufficient to be occupied by a sleeper so as to facilitate supporting every part of the sleeper's body uniformly and a less flexible peripheral portion formed by providing means for restricting swelling deformation of the peripheral portion to prevent oppression against the sleeper caused by the swelling of the peripheral portion adjacent the sleeper's body due to the weight of the sleeper on said flexible portion, said restricting means being constituted by an increased thickness in said peripheral portion as compared with the center portion of said top sheet of said bag.

2. A water bed as defined in claim 1, wherein said top sheet of said bag has a raised area in the center portion thereof which receives a sleeper's body.

* * * * *